United States Patent [19]

Kuehnle

[11] 4,419,004

[45] Dec. 6, 1983

[54] METHOD AND APPARATUS FOR MAKING TRANSPARENCIES ELECTROSTATICALLY

[75] Inventor: Manfred R. Kuehnle, New London, N.H.

[73] Assignee: Coulter Systems Corporation, Bedford, Mass.

[21] Appl. No.: 317,446

[22] Filed: Nov. 2, 1981

[51] Int. Cl.[3] ..... G03G 15/00

[52] U.S. Cl. ..... 355/3 TR; 355/3 P; 355/14 TR; 118/56; 118/641; 430/126; 430/130; 430/136

[58] Field of Search ..... 355/3 TR, 14 TR, 3 P; 118/640, 641, 56; 430/126, 130, 136, 98

[56] References Cited

U.S. PATENT DOCUMENTS

| | | | |
|---|---|---|---|
| 3,741,760 | 6/1973 | Snelling | 355/3 P X |
| 3,893,761 | 7/1975 | Buchan et al. | 118/641 X |
| 4,055,418 | 10/1977 | Buckley et al. | 430/126 X |
| 4,073,583 | 2/1978 | Teumer et al. | 355/3 P |
| 4,320,186 | 3/1982 | Kato et al. | 430/126 X |

*Primary Examiner*—A. C. Prescott

*Attorney, Agent, or Firm*—Silverman, Cass & Singer, Ltd.

[57] ABSTRACT

An electrostatic method of making transparencies and apparatus for practicing said method. An endless electrophotographic belt is charged, imaged and toned with a liquid toner suspension. The belt with the toned image is brought into close proximity to a precisely dimensioned gap defined by a heated roller over which is passed a strip of transfer material comprising a transparent substrate carrying a thin ohmic layer bonded thereto and a thin overcoat of resinous material on the ohmic layer and bonded thereto. An electrical bias is applied across the gap between the belt and the overcoated ohmic layer. The toner particles migrate electrophoretically toward the overcoated substrate. Heat is applied sufficient to melt the overcoating just prior or during the application of the electrical bias so that transfer occurs due to electrophoretic migration through the melt, thus embedding the transferred toner particles of the toner image within the resin. The transfer material is quickly cooled. The resulting transparency comprises the coated transparent member having the tone image embedded in the resin coating below the surface thereof.

5 Claims, 2 Drawing Figures

METHOD AND APPARATUS FOR MAKING TRANSPARENCIES ELECTROSTATICALLY

BACKGROUND OF THE INVENTION

This invention relates generally to image carrying transparencies and a method for making same and more particularly, concerns the provision of transparencies formed electrophotographically and comprising a transparent plastic sheet substrate carrying bonded thereto, a thin layer of a compatible resinous material itself carrying a toner image embedded within said material, the transfer being effected electrophoretically without residual material remaining on the electrophotographic recording member.

In U.S. Pat. No. 4,025,339 an electrophotographic member has been described which includes a photoconductive coating formed of a crystalline deposit of a wholly inorganic material on a suitable substrate such as a thin clear flexible plastic sheet with an intervening thin ohmic layer such as tin-indium oxide, by a sputtering method that results in unusual properties. The photoconductive coating has the ability to function as means for storing and selectively discharging an electrical charge. When exposed to light the radiation pattern forms a latent electrostatic image on the photo-conductor surface which is toned to render same visible.

It is known to transfer the toned electrostatic images to a receiving member which may comprise a thin transparent plastic sheeting. Transfer can be effected employing dry transfer methods conventionally described as cascade toning or development employing dry electroscopic toner particles. Alternatively, development of the electrostatic latent image can be effected using liquid toning techniques wherein toner particles are dispersed in suspension in an insulating hydrocarbon liquid. Liquid toner techniques offer improved resolution due to the small size of the dispersed particles. Accordingly, in order to take advantage of the unusual properties of the patented electrophotographic recording member, liquid toning methods conventionally are used.

Transfer of toned images directly to plastic receiving sheet members have been successful. Bias voltages have been employed during the transfer with success. Notwithstanding the production of transparency sheets using those known methods, adherence of the toner images on the substrate surface has been less than desirable. The advent of fusible toner particles alleviated the adhesion problem to some degree but the result was a surface which was not sufficiently smooth for use of the resultant transparency, say for optical projection. Further, the high resolution obtained using the patented electrophotographic recording member, as well as the optical density of the resultant image, was not always fully retained upon transfer. Lateral displacement was a problem.

Incomplete transfer often resulted, leaving a residue toner on the recording member, necessitating additional steps of carefully cleaning the electrophotographic surface of such residual deposit before reuse. The recording member itself could be used as a transparency providing the substrate was transparent but the photoconductive coating usually carried thereby has a characteristic tint to the substrate, yellow in color where CdS is used as the coating material. Such transparencies as result by fusing a toned transferred image onto the electrophotographic member are unsatisfactory because of such tint and because they are expensive in view of the cost of the recording medium.

Adhesive substances have been applied as a coating to sheet material but do not result in transfer without loss in resolution and optical density at selected areas. The transfers obtained are not satisfactory because the adhesive tends to result in so-called blocking, that is, bonding of the sheets together when placed thereupon even when cool. The blocking effect required the lamination of an additional thin foil of plastic over the image to protect its age of blocking, dust collection and scratching. Unfortunately, the thin overlay foil eliminates the making of contact duplicate films, a vital necessity in the film business, as it prevents direct image contact because the foil acts as a spacer. The resulting resolution loss introduced by light scatter in the space created by the foil becomes unacceptable.

SUMMARY OF THE INVENTION

Methods and apparatus for making high resolution transparencies electrostatically comprising electrophotographic imaging apparatus including an electrophotographic medium having an outer coating of microcrystalline wholly inorganic photoconductive material bonded to a substrate and capable of being charged and of holding a charge on the surface thereof in a magnitude sufficient to be imaged and toned, an exposure station for exposing the charged surface to a radiation pattern of an image to be reproduced to form an electrostatic latent charge image thereon, a toning station for development of said latent image, a transfer station, means for feeding transfer sheet material to said transfer station simultaneously with arrival of the toned image on the electrophotographic medium at said transfer station, said transfer sheet material carrying a meltable resin coating bonded thereto, said transfer station comprising a pair of roller members arranged to define a gap therebetween, means to cause electrophoretic migration of the toner image to the coating of the transfer material and the transfer sheet is cooled immediately after leaving the electrophotographic medium. After cooling, the transfer medium retains the toner image fully embedded within said now solid resin coating with full retention of the optical density and resolution of the toner image as formed on said electrophotographic medium.

The invention provides means for locally heating the transfer sheet at said gap to melt the resin coating so it becomes liquid causing the dispersing liquid of the toner to evaporate while substituting the molten resin as the new dielectric medium in which the toner particles can move and means for applying an electrical bias voltage across said gap while the resin is molten.

DESCRIPTION OF PREFERRED EMBODIMENTS

The invention, briefly, provides an electrophotographic apparatus for making transparencies, including an electrophotographic belt mounted on a pair of rollers to define a pair of opposite parallel reaches. The belt has a photoconductive coating on its outer surface which is capable of being charged and holding the charge sufficiently to be toned electrophoretically using liquid toner.

A transfer station is located immediately downstream of the toner or developing station.

The transfer station includes a roller about which is passed a transfer medium comprising a flexible substrate strip or sheet preferably formed of polyester plastic material. The transfer sheet also is provided with a thin layer of ohmic material and an overcoat of a resinous material compatible with the substrate.

A gap is defined between the transfer sheet and the image carrying belt surface. A bias voltage is applied to the transfer roller to enable electrically assisted migration of the toner particles from the surface of the belt to the coated surface. Localized heating along the gap is provided whereby the resin is melted at the gap. After transfer, the transfer sheet is cooled. Complete transfer of the toned image is effected with the toner particles comprising same embedded permanently within the coating. The transfer is effected electrophoretically with one roller functioning as a development electrode. Full transfer without loss of resolution or reduction of optical density is achieved.

The strip of transfer medium is formed by coating by using conventional coating methods. A sheet of polyester substrate material is formed of a polyethylene terpthalate polymer sold under the trademark MYLAR by DuPont Company of Wilmington, Delaware. The substrate is 5 mils in thickness and is heat treated by the manufacturer to increase its dimensional stability. The coating material is a polyester resin normally adherent to the substrate material, which is nonblocking, that is, will not (after application) either bond to itself or to the substrate. The coating material selected must be chemically resistant as well as abrasion resistant. The resin selected must melt at a temperature that does not effect the plastic substrate or lessen the adherence of the ohmic layer to the substrate. Additionally, the resin must quickly attain low viscosity when melted to allow easy mobility of the toner particles during the transfer process and it must exhibit a high electrical resistivity such as $10^{15}$ rcm to prevent discharge of the toner particles.

Figure 1:
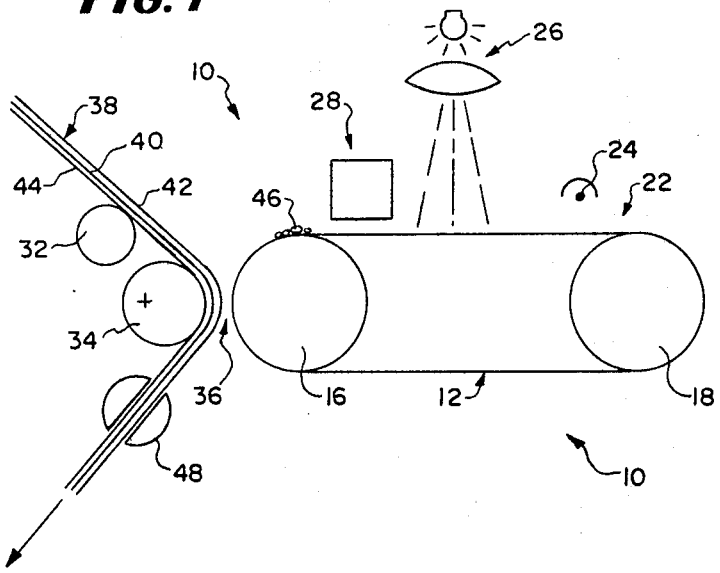
FIG. 1 is a diagrammatic view of the transparency making electrophotographic apparatus according to the invention.
Figure 2:
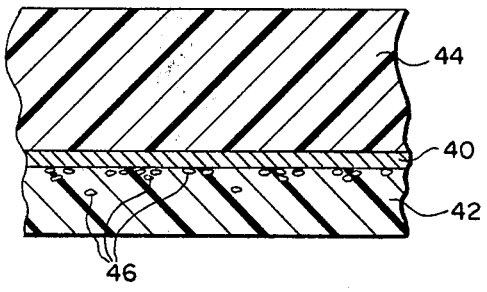
FIG. 2 is a cross-sectional transverse view of the transparency resulting from use of the apparatus of FIG. 1.

Referring to the drawing, FIG. 1 illustrates the electrophotographic system of the invention designated generally by reference 10. System 10 comprises an electrophotographic belt 12 mounted for rotation on a pair of rollers 14,16. The mounted belt 12 defines a pair of parallel reaches 18,20, the upper reach 18 being the imaging and toning reach.

The functional stations are positioned along the reaches 18,20 with the charging station 22 located at the commencement of reach 18. The charging station 22 includes a corona generating device 24 for applying a charge potential on the photoconductive coating on the outer surface of the electrophotographic belt.

The belt 12 is rotated to position the charged section thereof in position to receive a projected actinic radiation pattern of the image to be reproduced forming a latent electrostatic charge image of the pattern projected thereon at the projection station 26.

The belt then is again rotated to draw the image carrying portion to and through a development station 28 located downstream of the projected image, where the latent image is rendered visible electrophoretically by application thereto of a suspension of toner particles in an insulating liquid medium.

The toned image is then brought while still in darkness to the transfer station 30, preferably in a wet or at least moist state.

Transfer is caused by the electrical bias, the image being propelled into the molten liquid resin coating by the attraction toward the ohmic layer, the latter being subjected to a substantial external voltage applied between ohmic layer and photoconductive ground. Heating to melt the resin is applied at or prior to transfer.

The transfer station 30 preferably is located spaced from the development station 28 adjacent the mounting roller 16 for the electrophotographic belt to enable drying of the toned image in transit. The transfer station 30 includes a heated roller 32 arranged to be driven in a direction opposite to that of roller 16. The axes of rollers 34 and 16 are disposed to define a precisely spaced gap 36 between the strip 38 of transfer medium and the belt surface. A bias voltage of 50 to 100 V is generated between the ohmic layer 40 of the strip 38 of transfer medium and the ohmic layer of the electrophotographic belt 12.

The roller 32 heats the strip 38 of transfer medium sufficiently to liquify the resin coating 42 at the gap without melting or softening the substrate 44. The toner particles 46 under the influence of the bias voltage travel through the liquified resin to adhere to the surface of the ohmic layer 40 or at least closely proximate thereto. Because of the bias, the transfer is direct without lateral displacement or loss. No residue remains on the electrophotographic belt. The toner particles 46 thus deeply penetrate the overcoat 42. The resin resolidifies quickly after leaving the gap 36 so that the necessity for quick cooling the transfer medium immediately after transfer is not required but may be provided by cooling station 48. When cooled, the resin will be hard and will not "block" when engaged with other plastic layers.

Once past the gap, the toned image is embedded within the now solidified resin. The high resolution obtained during the electrophotographic process of imaging and toning is retained after transfer.

The high gloss, smooth abrasive, resistant transparency results, without loss in optical density, as transfer is complete. The belt can be immediately reused after transfer for a new series of imaging, etc.

Variations are capable of being made without departing from the spirit or scope of the invention as defined in the attached claims.

What I claim is:

1. A method of transferring an electrophotographically formed toner image comprising the steps of:

electrophotographically forming an electrostatic toner image on a flexible electrophotographic film member by successively charging the photoconductive surface, exposing the charged surface to actinic radiation through an interposed image pattern, forming a latent electrostatic charge image of said pattern on said photoconductive coating surface and toning the latent electrostatic charge image with liquid toner comprising discrete toner particles suspended in an electrically insulating liquid; providing a transparent transfer sheet consisting of a substrate having a thin ohmic layer and a thin coating of a resinous composition bonded to said ohmic layer, said resinous coating having a softening range lower than the softening range of the substrate; drying the toner image; locally heating the thin resin coating of the transfer sheet melting same, transporting the dry toner image carrying electrophotographic member and the transfer sheet material simultaneously to and through a precise gap defined therebetween with the melted resin coating facing and in proximity to the toner image carrying photoconductive surface, applying an electrical bias voltage across said gap during passage of said electrophotographic film member and said transfer sheet therethrough whereby electrophoretically to transfer said toner image to said sheet member and into the melted resin, separating said transfer sheet from said electrophotographic film, permitting the resin coating of the transfer sheet to cool with transferred toner image embedded within said resin layer whereby said transfer is effected without loss in resolution or optical density.

2. The process as claimed in claim 1 in which the transfer member is heated locally to melt the coating just prior to its entry into the gap.

3. The process as claimed in claim 1 and the step of warming the electrophotographic member just prior to transfer to remove any remainent insulating liquid, and the resin coating is melted just prior to entry thereof into the gap in melted condition.

4. The process as claimed in claim 1 in which no residue is left on the electrophotographic member subsequent to transfer.

5. Apparatus for practicing the method of claim 1 comprising an electrophotographic member, means for charging, exposing, toning said electrophotographic member with liquid toner to produce a toned electrostatic image thereon and drying the toner image, a transfer station including a transfer roller spaced from said electrophotographic member and defining therewith a predetermined toning gap, means for delivering a resin overcoated transfer member to said gap simultaneously with arrival thereat of the dry toner image carrying portion of said electrophotographic member, means for heating said resin overcoated transfer member locally at a location adjacent said gap to melt the resin overcoat thereof at least just prior to arrival at said gap, the toned image being transferred electrophoretically to the melted resin overcoat at said gap under the influence of said bias voltage, said toner image being embedded below the surface of said resin overcoat and means for permitting cooling of said transfer sheet subsequent to transfer.

* * * * *